US007185704B2

(12) United States Patent
Bigelow et al.

(10) Patent No.: US 7,185,704 B2
(45) Date of Patent: Mar. 6, 2007

(54) SERVICE TOOL WITH FLOW DIVERTER AND ASSOCIATED METHOD

(75) Inventors: Jason Bigelow, Torbay (CA); Nathan Kathol, Chestermere (CA); Craig Skeates, Calgary (CA)

(73) Assignee: Schlumberger Technology Corp., Sugar Land, TX (US)

( * ) Notice: Subject to any disclaimer, the term of this patent is extended or adjusted under 35 U.S.C. 154(b) by 117 days.

(21) Appl. No.: 10/948,016

(22) Filed: Sep. 23, 2004

(65) Prior Publication Data

US 2005/0087348 A1 Apr. 28, 2005

Related U.S. Application Data

(60) Provisional application No. 60/505,599, filed on Sep. 24, 2003.

(51) Int. Cl.
*E21B 43/26* (2006.01)

(52) U.S. Cl. ..... 166/308.1; 166/222; 166/177.5

(58) Field of Classification Search ..... 166/222, 166/308.1, 177.5
See application file for complete search history.

(56) References Cited

U.S. PATENT DOCUMENTS

| | | | | | |
|---|---|---|---|---|---|
| 1,875,414 | A | * | 9/1932 | Burt | 166/328 |
| 1,994,850 | A | * | 3/1935 | Burt | 166/222 |
| 1,998,833 | A | * | 4/1935 | Crowell | 166/194 |
| 2,153,034 | A | * | 4/1939 | Baker | 166/194 |
| 2,771,141 | A | * | 11/1956 | Lewis | 166/222 |
| 3,593,786 | A | * | 7/1971 | Lewis | 166/222 |
| 5,029,644 | A | | 7/1991 | Szarka et al. | 166/223 |
| 5,069,284 | A | * | 12/1991 | Gray | 166/311 |
| 5,249,628 | A | | 10/1993 | Surjaatmadja | 166/308 |
| 5,325,917 | A | | 7/1994 | Szarka | 166/240 |
| 5,361,856 | A | | 11/1994 | Surjaatmadja et al. | 175/67 |
| 5,375,661 | A | | 12/1994 | Daneshy et al. | 166/278 |
| 5,381,862 | A | | 1/1995 | Szarka et al. | 166/212 |
| 5,396,957 | A | | 3/1995 | Surjaatmadja et al. | 166/308 |
| 5,484,016 | A | | 1/1996 | Surjaatmadja et al. | 166/104 |
| 5,494,103 | A | | 2/1996 | Surjaatmadja et al. | 166/222 |
| 5,499,678 | A | | 3/1996 | Surjaatmadja et al. | 166/298 |
| 5,533,571 | A | | 7/1996 | Surjaatmadja et al. | 166/222 |
| 5,636,691 | A | * | 6/1997 | Hendrickson et al. | 166/278 |
| 6,253,853 | B1 | | 7/2001 | George | 166/320 |
| 6,286,599 | B1 | | 9/2001 | Surjaatmadja et al. | 166/298 |

* cited by examiner

*Primary Examiner*—William Neuder
*Assistant Examiner*—Nicole A Coy
(74) *Attorney, Agent, or Firm*—Rodney Warfford; Tim Curington; Robin Nava

(57) ABSTRACT

A downhole service tool is provided that may include a body having an interior passageway, at least one exit port through which fluid may flow from the interior passageway to an exterior of the tool, and at least one diverting channel adapted to cause fluid exiting the exit port to flow in a predetermined pattern, such as a helical or rotational flow path. The diverting channel may be in the form of a trough, and may also have a tapering width from its upper end to its lower end, where it meets the exterior of the tool. The diverting channel may also have a helical or other predetermined shape so as to facilitate the inducement of the desired flow pattern. By designing the tool so as to create a desired flow pattern, erosion of the tool by the exiting fluid flow is lessened. Related methods are also provided.

15 Claims, 2 Drawing Sheets

SERVICE TOOL WITH FLOW DIVERTER AND ASSOCIATED METHOD

CROSS-REFERENCE TO RELATED APPLICATIONS

This application claims priority from U.S. Provisional Application No. 60/505,599, filed Sep. 24, 2003, which is incorporated herein by reference.

BACKGROUND OF THE INVENTION

1. Field of the Invention

The present invention generally pertains to downhole service tools, and more particularly to a device and method for diverting flow exiting downhole service tools.

2. Description of the Related Art

It is known within the oil and gas industry to inject a variety of fluids or slurries into a downhole well through the use of a service tool connected to a service string. An example of such a service tool can be found in U.S. Pat. No. 5,029,644 issued on Jul. 9, 1991 to Szarka et al. Prior service tools are deficient, however, in that they are prone to being eroded by the exiting fluid, which erosion thereby shortens the life of the service tool. As will become apparent from the following description and discussion, however, the present invention overcomes the deficiencies of the previous devices and constitutes an improved and more efficient service tool for use in injecting fluids and slurries into a downhole well.

SUMMARY OF THE INVENTION

In a broad aspect, the present invention is a service tool comprising: a body having an interior passageway, an exterior, and at least one exit port, the at least one exit port providing fluid communication between the interior passageway and the exterior of the body, the at least one exit port being shaped to induce a predefined flow pattern to fluid exiting the exit port. Another feature of this aspect of the invention is that the predefined flow pattern is circular. Another feature of this aspect of the invention is that the body further includes at least one diverting channel adapted to induce the predefined flow pattern. Another feature of this aspect of the invention is that the diverting channel defines a helical flow path. Another feature of this aspect of the invention is that the diverting channel extends downwardly from a longitudinal axis of the tool to the exterior of the body. Another feature of this aspect of the invention is that the diverting channel is a trough. Another feature of this aspect of the invention is that the diverting channel includes a gradually-decreasing width from a first width at an upper end thereof to a relatively smaller second width at the exterior of the body.

In some embodiments the present invention provides a service tool comprising a body having an interior passageway, an exterior, at least one exit port, and at least one diverting channel, the at least one exit port providing fluid communication between the interior passageway and the exterior of the body, the at least one diverting channel being shaped to induce a predefined flow pattern to fluid exiting the exit port. Another feature of this aspect of the invention is that the diverting channel is a helical trough. Another feature of this aspect of the invention is that the predefined flow pattern is circular. Another feature of this aspect of the invention is that the diverting channel extends downwardly from a longitudinal axis of the tool to the exterior of the body. Another feature of this aspect of the invention is that the diverting channel includes a gradually-decreasing width from a first width at an upper end thereof to a relatively smaller second width at the exterior of the body.

Another embodiment of the present invention is a method of reducing erosion of a downhole tool, comprising flowing fluid from an interior passageway of the tool to an exterior of the tool through an exit port in the tool; and inducing a predetermined flow pattern to the fluid exiting the exit port. Another feature of this aspect of the invention is flowing the fluid along a diverting channel. Another feature of this aspect of the invention is that the diverting channel is a helical trough. Another feature of this aspect of the invention is that the diverting channel extends downwardly from a longitudinal axis of the tool to the exterior of the tool. Another feature of this aspect of the invention is that the diverting channel includes a gradually-decreasing width from a first width at an upper end thereof to a relatively smaller second width at the exterior of the tool. Another feature of this aspect of the invention is flowing the fluid along a helical path. Another feature of this aspect of the invention is inducing a rotational flow pattern to the exiting fluid. Another feature of this aspect of the invention is inducing a helical flow pattern to the exiting fluid. Another feature of this aspect of the invention is flowing the fluid along a trough in the tool.

In another embodiment, the present invention comprises providing fluid to a service tool via a service string, wherein the service tool comprises a body having an interior passageway, an exterior, and at least one exit port, the at least one exit port providing fluid communication between the interior passageway and the exterior of the body, the at least one exit port being shaped to induce a predefined flow pattern to fluid exiting the exit port; and injecting the fluid into the wellbore through the at least one exit port. In some embodiments, the invention may further comprise flowing the fluid along a diverting channel. The diverting channel may be a helical trough. In some embodiments, the diverting channel extends downwardly from a longitudinal axis of the tool to the exterior of the tool. In some embodiments, the diverting channel includes a gradually-decreasing width from a first width at an upper end thereof to a relatively smaller second width at the exterior of the tool. Embodiments of the present invention further comprise flowing the fluid along a helical path. Embodiments of the present invention further comprise flowing the fluid along a trough in the tool. Some embodiments include inducing a rotational flow pattern to the exiting fluid. Some embodiments include inducing a helical flow pattern to the exiting fluid.

Other features, aspects and advantages of the present invention will become apparent from the following discussion.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
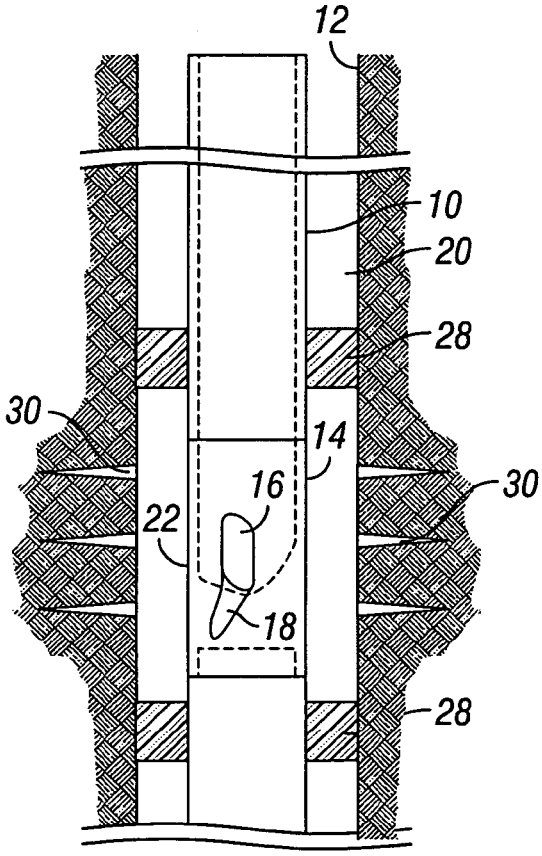
FIG. 1 is a side view of a specific embodiment of a downhole service tool constructed in accordance with the present invention and disposed within a well.

Referring to the drawings in detail, wherein like numerals denote identical elements throughout the several views, there is shown in FIG. 1 a service string 10 positioned in a well 12. The service string 10 may comprise coiled tubing, jointed tubing, or some other conduit. A service tool 14 constructed in accordance with the present invention is connected to the service string 10. The service tool 14 may include a body member 22 having an exit port 16 and a diverting channel 18 that has a tapered region. The exit port 16 provides flow communication from an interior passageway of the service tool 14 to an exterior of the service tool 14. The exit port 16 and diverting channel 18 are shaped to induce a controlled, predefined flow pattern as fluid or slurry exits the tool 14.

Figure 2:
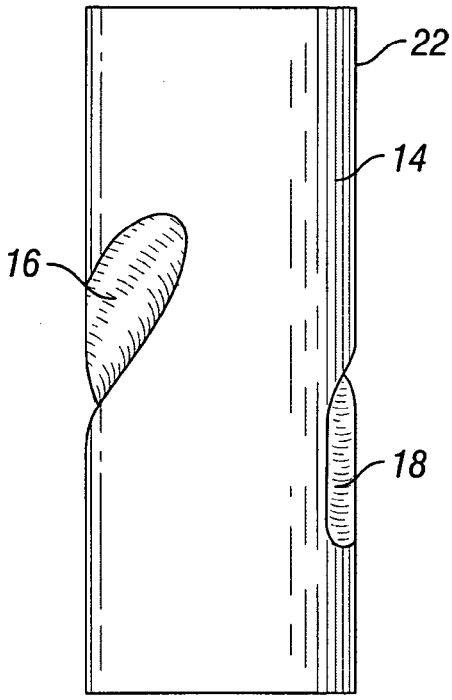
FIG. 2 is another side view of a specific embodiment of a downhole service tool constructed in accordance with the present invention.

In a specific embodiment, the exit port 16 and diverting channel 18 may be shaped to induce a circular or rotational flow into a well annulus 20 formed between the well 12 and the service string 10. To accomplish the controlled, predefined flow pattern, the exit port 16 and diverting channel 18 define a flow path that diverts the exiting fluid or slurry along a predetermined path. In a specific embodiment, the tapered region of the diverting channel 18 redirects the flow from the service tool 14 to produce the controlled, predefined flow pattern. In a specific embodiment, as shown for example in FIG. 2, the diverting channel 18 may follow a helical tapering path that produces a swirling fluid flow exiting the tool 14. It has been found that such a design extends the life length of the tool 14 significantly by reducing tool erosion by the fluid.

In use, as shown in FIG. 1, the service tool 14 may be positioned within the well 12 adjacent perforations 30. In addition, packers 28 (such as cup packers or other suitable isolation devices) may be provided above and below the service tool 14 so as to seal the annulus above and below the perforations 30 and thereby direct the treatment fluid exiting the tool 14 into a specific area of the formation, such as into the perforations 30.

Figure 3:
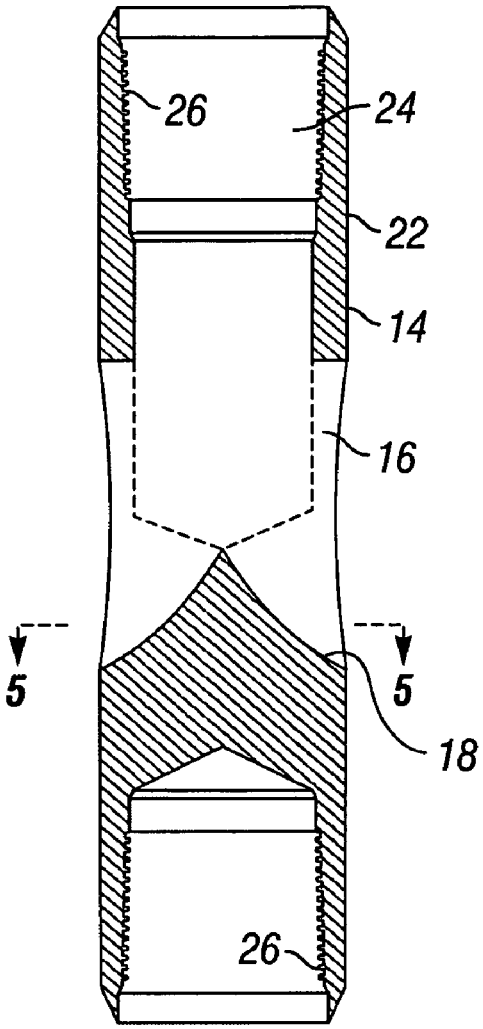
FIG. 3 is another side view of a specific embodiment of a downhole service tool constructed in accordance with the present invention.
Figure 4:
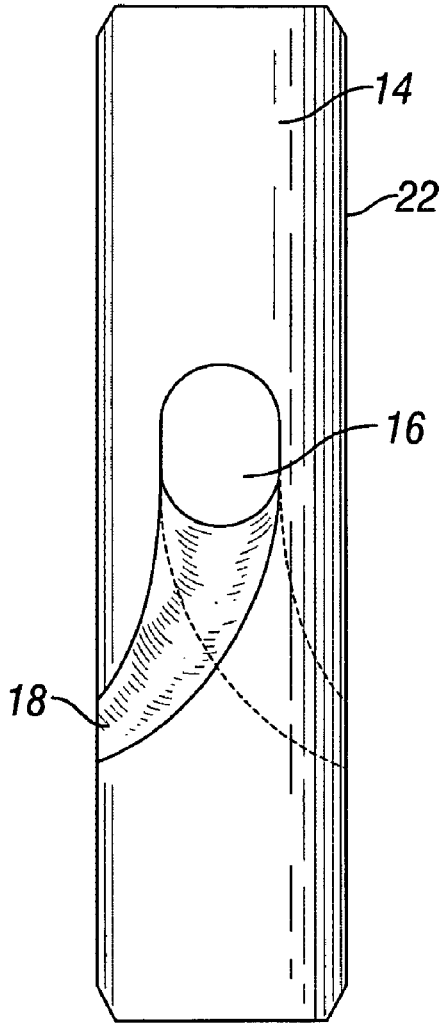
FIG. 4 is a side view of the tool shown in FIG. 3.
Figure 5:
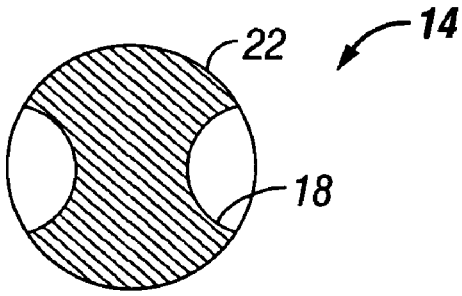
FIG. 5 is a cross-sectional view taken along line 5—5 of FIG. 3.

Another specific embodiment of the present invention is shown in FIGS. 3–5. In this embodiment, it can be seen that the interior passageway 24 of the service tool 14 may be provided with threads 26 for connection to the service string 10. As is known to those of skill in the art, the interior passageway 24 of the service tool 14 communicates with a similar interior passageway in the service string 10. In this embodiment, as best seen in FIGS. 3 and 4, it can be seen that the tool 14 includes two exit ports 16 and two diverting channels 18. Each diverting channel 18 extends downwardly from a longitudinal axis of the tool 14 to the exterior of the tool 14. In a specific embodiment, the diverting channel 18 may be in the form of a trough, and may also be helically shaped. The width of the diverting channel 18 may gradually decrease in size from a first width at the longitudinal axis, or at an upper end of the diverting channel, to a relatively smaller second width at the exterior of the tool 14. FIGS. 3–5 further illustrate how fluid or slurry flowing down through the service string 10 will flow into the interior passageway of the service string 10 and then along the diverting channels 18 and out through the one or more exit ports 16 in a predefined flow pattern (e.g., swirling) as it exits the tool 14. When two or more exit ports 16 and diverting channels 18 are used, they may each work in unison with the others to further enhance the desired flow pattern.

Fluids or slurries may be flowed from the surface through the service string 10 into the wellbore 12 and spotted or placed at the desired location in the well 12 through the exit ports 16 of the service tool 14. For example, stimulation or fracturing fluid may be injected into the well 12 via a service string 12 to inject fracturing fluid into perforated gas zones. By use of the present invention in these and other fluid injection scenarios, the fluids or slurries will exit the service tool 14 in a desired flow pattern, thereby extending the life of the service tool 14 in relation to prior service tools.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method of fracturing a well comprising:

providing a fracturing tool comprising:

an interior passageway, an exterior, and at least one exit port providing fluid communication between the interior passageway and the exterior of the fracturing tool;

flowing a fracturing fluid into the fracturing tool;

directing the fracturing fluid from the interior passageway of the fracturing tool to the exterior of the fracturing tool through the at least one exit port and into perforations in the well to fracture the well; and reducing erosion of the fracturing tool by shaping the at least one exit port in a manner that induces a swirling flow pattern to the fracturing fluid exiting the exit port.

2. The method of claim 1, wherein said directing further comprises setting packers above and below said perforations.

3. The method of claim 1, wherein the interior passageway and the at least one exit port form a continuous unobstructed fluid passageway.

4. The method of claim 3, wherein the fracturing tool does not include a ball valve between the interior passageway and the at least one exit port.

5. A method of fracturing a well comprising:

providing a fracturing tool comprising:

an interior passageway, an exterior surface, and at least one exit port providing fluid communication between the interior passageway and the exterior surface of the fracturing tool, and being shaped to induce a swirling flow pattern to fluid exiting the exit port;

flowing a fracturing fluid into the fracturing tool; and directing the fracturing fluid from the interior passageway to the exterior surface of the fracturing tool through the at least one exit port and into perforations in the well to fracture the well.

6. The method of claim 5, further comprising providing a diverting channel between the interior passageway and the at least one exit port.

7. The method of claim 6, wherein the diverting channel is a helical trough.

8. The method of claim 6, wherein the diverting channel extends downwardly from a longitudinal axis of the tool to the exterior of the tool.

9. The method of claim 6, wherein the diverting channel includes a gradually-decreasing width from a first width at an upper end thereof to a relatively smaller second width at the exterior of the tool.

10. The method of claim 6, wherein the diverting channel is shaped in a helical path.

11. The method of claim 5, wherein the swirling flow pattern is rotational.

12. The method of claim 5, wherein the swirling flow pattern is.

13. The method of claim 5, wherein said directing further comprises setting packers above and below said perforations.

14. The method of claim 5, wherein the interior passageway and the at least one exit port form a continuous unobstructed fluid passageway.

15. The method of claim 14, wherein the fracturing tool does not include a ball valve between the interior passageway and the at least one exit port.

* * * * *